US012768263B2

(12) United States Patent
Wrighton et al.

(10) Patent No.: US 12,768,263 B2
(45) Date of Patent: Oct. 20, 2026

(54) DETERMINING ELECTRICAL SUBMERSIBLE PUMP LIFETIME EXPECTANCY

(71) Applicant: Saudi Arabian Oil Company, Dhahran (SA)

(72) Inventors: Christopher Wrighton, Rothienorman (GB); Sakethraman Mahalingam, Aberdeen (GB)

(73) Assignee: Saudi Arabian Oil Company, Dhahran (SA)

( * ) Notice: Subject to any disclaimer, the term of this patent is extended or adjusted under 35 U.S.C. 154(b) by 363 days.

(21) Appl. No.: 18/465,738

(22) Filed: Sep. 12, 2023

(65) Prior Publication Data

US 2025/0084756 A1 Mar. 13, 2025

(51) Int. Cl.
*E21B 47/008* (2012.01)
*F04D 15/00* (2006.01)

(52) U.S. Cl.
CPC ..... *E21B 47/008* (2020.05); *F04D 15/0088* (2013.01)

(58) Field of Classification Search
CPC .. E21B 47/008; E21B 43/128; F04D 15/0088; F04D 13/10
See application file for complete search history.

(56) References Cited

U.S. PATENT DOCUMENTS 4,128,735 A * 12/1978 Zehren ..... H02K 5/225 277/606
5,319,272 A 6/1994 Raad
6,481,973 B1 * 11/2002 Struthers ..... F04D 15/0066 417/43
6,741,000 B2 5/2004 Newcomb
8,067,865 B2 11/2011 Savant
(Continued)

FOREIGN PATENT DOCUMENTS

CA 1226325 9/1987
CA 2230691 3/2004
(Continued)

OTHER PUBLICATIONS

International Search Report and Written Opinion in International Appln. No. PCT/US2024/046201, mailed on Dec. 3, 2024, 13 pages.
(Continued)

*Primary Examiner* — Nathan C Zollinger
(74) *Attorney, Agent, or Firm* — Dinsmore & Shohl LLP

(57) ABSTRACT

An assembly and a method for determining a lifetime expectancy of the electrical submersible pump. An assembly includes a motor, a motor head coupled to the motor, a power cable, a sensor module, and a local controller. The motor head has one or more toroidal transformers. The power cable extends into the motor head through the toroidal transformers to the motor. The sensor module receives power from toroidal transformers, detects a condition of the motor, and transmits a signal representing the condition of the motor. The local controller receives electrical power from the toroidal transformers; receives the signal representing the condition of the motor; based on the condition of the motor, determines a mass flow rate of the motor; and based on the mass flow rate of the motor, determines a life expectancy of the motor.

18 Claims, 2 Drawing Sheets

(56) References Cited

U.S. PATENT DOCUMENTS

| | | | | |
|---|---|---|---|---|
| 8,322,444 | B2 | 12/2012 | Camargo | |
| 8,571,798 | B2 * | 10/2013 | Atherton | G01F 1/74 417/44.11 |
| 8,624,530 | B2 * | 1/2014 | Chung | H02J 3/1892 318/16 |
| 8,932,034 | B2 | 1/2015 | McKinney et al. | |
| 9,670,739 | B2 * | 6/2017 | Tosi | E21B 43/123 |
| 10,323,641 | B2 | 6/2019 | Tanner et al. | |
| 10,337,302 | B2 | 7/2019 | Roth et al. | |
| 10,778,124 | B2 | 9/2020 | Hawes et al. | |
| 10,876,393 | B2 | 12/2020 | Rendusara et al. | |
| 11,095,191 | B2 | 8/2021 | Wrighton et al. | |
| 11,697,982 | B2 * | 7/2023 | Wrighton | H02K 5/1285 417/423.3 |
| 11,913,464 | B2 | 2/2024 | Wrighton | |
| 2006/0090892 | A1 | 5/2006 | Wetzel et al. | |
| 2011/0169353 | A1 | 7/2011 | Endo | |
| 2012/0091833 | A1 | 4/2012 | Hackett et al. | |
| 2013/0119830 | A1 | 5/2013 | Hautz et al. | |
| 2013/0272898 | A1 | 10/2013 | Toh et al. | |
| 2014/0265337 | A1 | 9/2014 | Harding et al. | |
| 2015/0323130 | A1 | 11/2015 | Meyer et al. | |
| 2016/0164377 | A1 | 6/2016 | Gauthier et al. | |
| 2017/0051591 | A1 | 2/2017 | Honekamp | |
| 2017/0122074 | A1 | 5/2017 | Robertson | |
| 2017/0343006 | A1 | 11/2017 | Ehrsann et al. | |
| 2017/0346371 | A1 | 11/2017 | Gruetzner et al. | |
| 2020/0220431 | A1 | 7/2020 | Wrighton et al. | |
| 2020/0362672 | A1 | 11/2020 | Joshi et al. | |
| 2022/0065081 | A1 | 3/2022 | Wrighton et al. | |
| 2022/0333608 | A1 | 10/2022 | Wrighton et al. | |

FOREIGN PATENT DOCUMENTS

| | | | |
|---|---|---|---|
| CA | 2949533 | A1 * | 11/2015 |
| DE | 102008001607 | | 11/2009 |
| DE | 102012022453 | | 5/2014 |
| DE | 102013200450 | | 7/2014 |
| DE | 102012205757 | | 8/2014 |
| JP | H05219687 | | 8/1993 |
| JP | 2000341908 | | 12/2000 |
| JP | 2002058207 | | 2/2002 |
| JP | 2010104206 | | 5/2010 |
| JP | 2013110910 | | 6/2013 |
| RU | 122531 | | 11/2012 |
| WO | WO 2014127035 | | 8/2014 |
| WO | WO 2017023320 | | 2/2017 |
| WO | WO 2018022198 | | 2/2018 |

OTHER PUBLICATIONS ieeexplore.ieee.org [online], "IEEE Standard for Broadband over Power Line Networks: Medium Access Control and Physical Layer Specifications," Dec. 2010, retrieved on May 20, 2024, retrieved from URL <https://ieeexplore.ieee.org/document/5678772>, 4 pages.

* cited by examiner

DETERMINING ELECTRICAL SUBMERSIBLE PUMP LIFETIME EXPECTANCY

TECHNICAL FIELD

This disclosure relates to an electrical submersible pump for pressurizing fluids in a wellbore, for example, one through which hydrocarbons or water are produced.

BACKGROUND

Fluids such as hydrocarbons and water are trapped in subterranean reservoirs. Wellbores are drilled through subterranean formations to the reservoirs to raise the hydrocarbons to the surface. Sometimes, pumps are used to pressurize and flow the hydrocarbons and water to the surface. Over time, the pumps can deteriorate and fail.

SUMMARY

This disclosure describes technologies related to electrical submersible pumps for pressurizing fluids in a wellbore. The electrical submersible pump uses a toroidal transformer to harvest power from a power cable extending from the surface to the motor of the electrical submersible pump. The power from the toroidal transformer powers sensor modules which determine the life expectancy of the electrical submersible pump based on conditions of the motor of the electrical submersible pump.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

Figure 1:
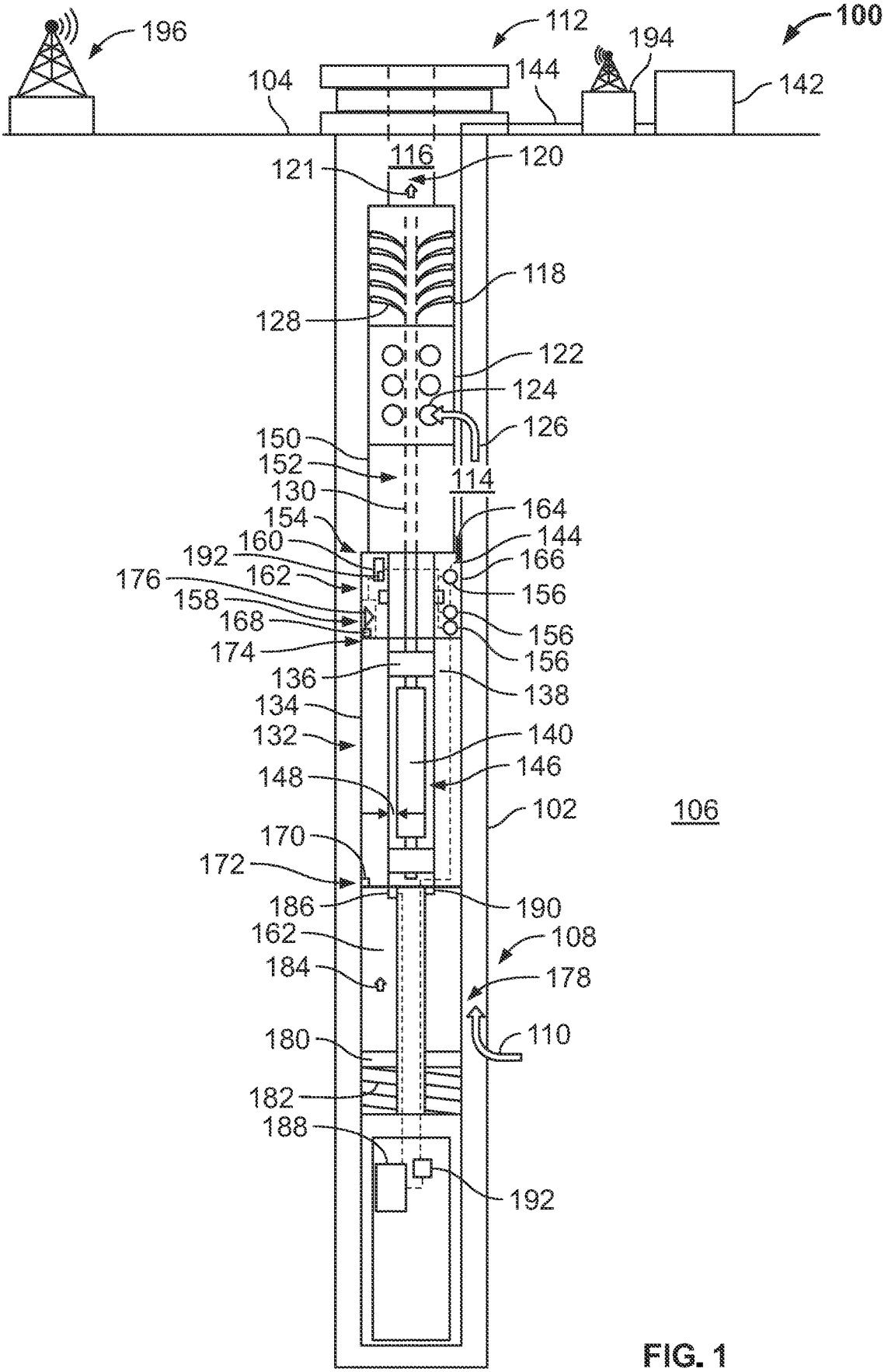
FIG. 1 is a schematic view of an electrical submersible pump assembly disposed in a wellbore.

The present disclosure describes an assembly and a method for determining a lifetime expectancy of an electrical submersible pump. The electrical submersible pump assembly is positioned in a wellbore of an oil and gas well to pressurize the fluids in the wellbore and flow the fluids to a surface of the Earth. The electrical submersible pump assembly includes a motor, a motor head with one or more toroidal transformers, a power cable, a sensor module, and a local controller. The motor head is coupled to the motor. The power cable extends into the motor head and through the one or more toroidal transformers to the motor. Electricity flowing through the power cable generates power in the one or more toroidal transformers. The toroidal transformers supply power to the sensor module and the local controller.

The sensor module detects a condition of the motor and sends a signal representing the condition of the motor to the local controller. The local controller is contained within the motor head and coupled to the motor and the sensor module. The local controller receives electrical power from the one or more toroidal transformers and receives the signal representing the condition of the motor. Then, based on the condition of the motor, the local controller determines a life expectancy of the motor.

Implementations of the present disclosure realize one or more of the following advantages. Operating life of the electrical submersible pump can be increased. For example, the release of clean dielectric oil displaces conductive wellbore fluids entering the motor past a degrading or failing motor seal, which can create an electrical short between motor components.

Preventative and corrective maintenance conducted on electrical submersible pumps can be decreased. For example, some motor components can be isolated from wellbore fluid for a longer time period, increasing component mean time between failures. Increasing the mean time between failures can increase the time period between scheduled preventive maintenance and required corrective maintenance, which will further reduce the total well cost. Reducing the total well cost can change the total well cost from a loss to a profit.

Wellbore completion maintenance can be decreased. For example, an expected end of life point in time can be determined and a planned wellbore entry and replacement of the electrical submersible pump can be conducted before the electrical submersible pump fails, but not too early while the electrical submersible pump still has remaining useful life. The expected end of life point in time is when the electrical submersible pump is expected to fail.

Wellbore completion assembly corrective maintenance can be performed sooner after a failure. For example, when well fluids have breached a seal or protector above or below the motor, or in some other manner ingresses into the motor, it can be detected earlier. These well fluids, which if not stopped, can lower an insulation rating of the dielectric oil in the motor leading to an electrical short to earth as the insulation resistance of the dielectric oil falls below the required rating and failure of the motor. Early warning after a failure can alert the operator to perform corrective maintenance before a total failure of the electrical submersible pump assembly.

An operator's understanding of wellbore conditions can be improved. For example, the electrical submersible pump motor and motor head can include sensors to detect wellbore conditions near the electrical submersible pump motor and motor head. The signals representing the conditions can be transmitted from the sensors to the local controller, and from the local controller to a remote controller on the surface. The operator can analyze the conditions from the sensors to gain an improved understanding of wellbore conditions.

An operator's understanding of other components and sub-assemblies of the electrical submersible pump can be improved. For example, the local controller of the motor head can communicate with other local controllers which operatively control the other components and sub-assemblies of the electrical submersible pump assembly. The local controllers can exchange data about their respective operating conditions or wellbore conditions. Each of the local controllers can be a communications node. The signals representing the operating conditions can be transmitted between the local controllers and to the remote controller on the surface. The operator can analyze the conditions from the sensors to gain an improved understanding of each of the communications nodes.

The time to alert an operator about electrical submersible pump conditions and wellbore conditions can be decreased. For example, by processing data related to the electrical submersible pump and the conditions in the wellbore at the electrical submersible pump instead of transmitting the data directly to the surface or a remote operating station can decrease, data transfer latency before processing can be decreased, decreasing the time to alert an operator about electrical submersible pump conditions and wellbore conditions. This can be referred to as edge processing.

FIG. 1 is a schematic view of an electrical submersible pump assembly 100 disposed in a wellbore 102. The wellbore 102 extends from the surface 104 of the Earth into subterranean formations 106 of the Earth. The formations 106 of the Earth contain fluids such as hydrocarbons and water. The fluids are in various phases of liquids and gases. The wellbore 102 includes openings 108 that allow the fluids to flow from the formations 106 into the wellbore 102 in the direction of arrow 110 and up to the surface 104 of the Earth. A wellhead assembly 112 is mechanically coupled to the wellbore 102 to seal the wellbore fluids in the wellbore 102 and control the flow of the wellbore fluids out of the wellbore 102. The wellhead assembly 112 is positioned on the surface 104 of the Earth. The wellhead assembly 112 can include a series of valves, chokes, spools, and fittings to control the flow of the wellbore fluids from the wellbore 102.

The electrical submersible pump assembly 100 can be disposed in the wellbore 102 to pressurize the fluids in the wellbore 102. Pressurizing the fluids in the wellbore 102 flows the fluids from a downhole location 114 to an uphole location 116 through a tubing 118. The uphole location 120 can be the surface 104 of the Earth in the direction of arrow 121.

The assembly 100 includes a pump 122. The pump 122 increases the pressure of the wellbore 102 at the downhole location 114 by creating a suction force to flow the fluids into a through suction inlets 124 from the downhole location 114 in the direction of arrow 126. The pump 122 can be a multi-stage centrifugal pump. The pump 122 includes impellers 128. The impellers 128 rotate, increasing a pressure and velocity of the fluids. The pump 122 includes a drive shaft 130 coupled to the impellers 128. The drive shaft 130 rotates within the pump 122 to rotate the impellers 128.

The assembly 100 includes a motor 132. The motor 132 can be a rotary electro-magnetic machine. For example, the motor 132 can be a squirrel cage induction motor. The motor 132 is coupled to the drive shaft 130 to rotate the pump 122. The drive shaft 130 extends through the pump 122 and into the motor 132. The motor 132 includes a motor body 134. The motor body 134 seals the motor 132 components from the wellbore fluids. The drive shaft 130 is centered within the motor body 134 by a bearing set 136.

The motor 132 includes a stator 138 and a rotor 140. The stator 138 is positioned within and coupled to the motor body 134. Electricity flows from a power source 142 on the surface 104 of the Earth through a power cable 144 coupled to the stator 138. Electricity flowing through the stator 138 generates a magnetic field. The power source 142 can be a renewable remote power source such as a solar panel or a commercial electrical grid. The power source 142 can include a power storage device, for example, a battery or a capacitor. The rotor 140 is positioned within the motor body 134 relative to the stator 138. The rotor 140 is mechanically coupled to the drive shaft 130. The rotor 140 rotates in response to the magnetic field generated by the stator 138. As the rotor 140 rotates in response to the magnetic field, the drive shaft 130 rotates, causing the impellers 128 to rotate and fluid to flow from the wellbore 102 into the suction inlets 124 in an uphole direction 121.

In some implementations, the power cable 144 is a single conductor, that is, a single wire (a single-phase system). In other implementations, the power cable 144 has three conductors, that is, three wires (a three-phase system).

Inside the motor body 134, the stator 138 and the rotor 140 define a void 146. The rotor 140 is spaced from (separated from) the stator 138 by a dimension 148. The dimension 148 can be referred to as an annular clearance or a stator 138-rotor 140 gap. The void 146 is filled with a dielectric oil. The dielectric oil is an electrical insulator which prevents a flow of an electric current directly from the stator 138 to the rotor 140. The flow of an electric current directly from the stator 138 to the rotor 140 is an electric short which can result in motor 132 failure. Also, the dielectric is circulated around the void 146 to lubricate and cool the rotor 140 and the bearing set 136.

The electrical submersible pump assembly 100 includes a protector/seal 150. The protector/seal 150 is coupled to the pump 122 and positioned in between the motor 132 and the pump 122 to prevent a flow of wellbore fluids from entering the motor body 134. The protector/seal 150 is coupled to the drive shaft 130 to define a sealing surface 152 to prevent the flow of wellbore fluids from entering the motor body 134. Over time and due to wellbore 102 conditions, the structural integrity of the protector/seal 150 can degrade, reducing the sealing effectiveness of the protector/seal 150. The protector/seal 150 can degrade due to wellbore 102 conditions such as pressure, temperature, and/or corrosive or abrasive substances in fluids in the wellbore 102. When protector/seal 150 sealing effectiveness degrades, fluids from the wellbore 102 can leak by the sealing surface 152 into the void 146 of the motor body 134. The leaked fluids can comingle with or displace the dielectric oil in the void 146. When the wellbore fluids comingle with the dielectric oil, the electric current can flow through the mixture of wellbore fluids and dielectric oil and short the stator 138 and the rotor 140, resulting in motor 132 failure. The mixture of the fluids and dielectric oil can be referred to as a contaminated dielectric oil.

The electrical submersible pump assembly 100 includes a motor head 154 coupled between the motor 132 and the protector/seal 150. The motor head 154 has one or more toroidal transformers 156, a sensor module 158, and a local controller 160. The motor head 154 couples the motor 132 to the protector/seal 150. The power cable 144 extends into and through the motor head 154. The power cable 144 extends through the one or more toroidal transformers 156 within the motor head 154. Electricity flowing along the power cable 144 generates electricity in the one or more toroidal transformers 156. The toroidal transformers 156 are electrically coupled to the sensor module 158 and the local controller 160 to supply electrical power to the sensor module 158 and the local controller 160. The sensor module 158 receives power from the toroidal transformers 156, detects a condition of the motor 132, and transmits a signal representing the condition of the motor 132 to the local controller 160. The motor head 154, the sensor module 158, and the local controller 160 are described in more detail below.

The motor head 154 has a case 162. The case 162 surrounds and protects the sensor module 158, the toroidal transformer 156, and the local controller 160 from fluids in the wellbore 102 and fluids received from the void 146 of the motor 132.

The motor head 154 has a pothead 164 coupled to the case 162. The power cable 144 is coupled to the pothead 164. The pothead 164 transitions the power cable 144 into the motor head 154. The pothead 164 seals to the case 162 on an outer surface 166 to prevent fluids from the wellbore 102 entering the motor head 154 about the power cable 144.

In some implementations, the one or more toroidal transformers 156 are a single toroidal transformer 156. In such cases, the local controller 160 can include a rectifier (not shown) and/or voltage regulator to adjust the electrical power. In some implementations, the one or more toroidal transformers 156 include three toroidal transformers 156, one for each phase of power in a three-phase system.

In some implementations, motor head 154 has an electrical storage device 198. The electrical storage device 198 can receive electrical power from the toroidal transformers 156 and store the electrical power for later use. The local controller 160 is operatively and electrically coupled to the electrical storage device 198. The local controller 160 can control the supply of electrical power between the toroidal transformers 156, the electrical storage device 198, and the sensor module 158. When the motor 132 of the electrical submersible pump assembly 100 loses power, for example when the power cable becomes damaged or the power source 142 fails, the electrical storage device 198 can supply power to the local controller 160 and the sensor module 158 to continue operating. Some examples of electrical storage device include a battery or a capacitor.

The sensor module 158 is coupled to the toroidal transformers 156 and the local controller 160. The sensor module 158 receives electrical power from the toroidal transformers 156. In some cases, the sensor module 158 receives the electrical power directly from the toroidal transformers 156. In other cases, the toroidal transformers 156 supply the electrical power to the local controller 160, which then delivers the electrical power to the sensor module 158. The sensor module 158 senses a condition of the motor 132 and transmits a signal representing a value of the condition to the local controller 160.

The sensor module 158 includes a first temperature sensor 168. The first temperature sensor 168 senses a differential temperature across the motor 132. The differential temperature across the motor 132 is sensed on the outer surface 166. The first temperature sensor 168 senses the differential temperature across the motor 132 and generates a signal representing a value of the differential temperature and transmits the signal representing the value of the differential temperature to the local controller 160. The first temperature sensor 168 monitors the differential temperature of the fluids in the wellbore 102 as the fluids flow across the outer surface 166 of the motor 132. Depending upon an operating point (a mass flow rate of the fluids in the motor 132) of the motor 132, a power loss in motor 132 can be determined by the local controller 160. The power loss in the motor 132 is lost to the fluids in the wellbore 102 as heat, so that an increase in the temperature of the fluids in the wellbore 102 across the motor 132 (the differential temperature sensed by the first temperature sensor 168) can be used to determine the mass flow rate of the produced fluids by the local controller 160 as described below in more detail.

The sensor module 158 can include a second temperature sensor 170 coupled to the motor 132 and positioned at a downhole end 172 of the motor 132, away from the motor head 154. The second temperature sensor 170 senses a temperature as the outer surface 166 of the motor 132 at the downhole end 172 of the motor 132 and generates a signal representing a value of the temperature at the downhole end 172 and transmits the signal representing the value of the temperature at the downhole end 172 to the local controller 160. When the sensor module 158 includes the second temperature sensor 170, the first temperature sensor 168 can be configured to sense a temperature at the outer surface 166 of the motor at an uphole end 174 if the motor 132 and transmits the signal representing the value of the temperature at the uphole end 174 to the local controller 160. The differential temperature across the motor 132 can be calculated taking the difference between the first temperature measured by the first temperature sensor 168 at the uphole end 174 and the second temperature measured by the second temperature sensor 170 at the downhole end 172 of the motor 132.

The sensor module 158 can included other sensors 176 to determine conditions of the fluids in the wellbore 102, the fluids received from the motor 132, or the motor 132. For example, the sensors 176 can sense a pressure in the wellbore 102, a pressure in the motor head 154, a resistance to the flow of electricity of the motor 132 component, a vibration of the motor 132, a temperature of a motor 132, or a property of the dielectric oil within the motor head 154. The sensors 176 transmits a signal representing a value of the sensed condition to the local controller 160.

The local controller 160 receives electrical power from the toroidal transformers 156. In some cases, the local controller 160 supplies the electrical power to the sensor module 158. The local controller 160 can include electrical circuits to rectify or regulate the electrical power received from the toroidal transformers 156.

The local controller 160 can include a computer with a microprocessor. The accumulator local controller 160 has one or more sets of programmed instructions stored in a memory or other non-transitory computer-readable media that stores data (e.g., connected with the printed circuit board), which can be accessed and processed by a microprocessor. The programmed instructions can include, for example, instructions for sending or receiving signals and commands to receive signals indicated the conditions of the wellbore 102 and the motor 132 from the sensor module 158 and based on the conditions, determine a life expectancy of the electrical submersible pump assembly 100. Processing data from the sensor module 158 at the local controller 160 can improve processing speed and accuracy, a concept know as edge processing.

The local controller 160 determines the life expectancy of the motor 132. The local controller 160 receives the signal representing the condition of the motor 132 from the sensor module 158; based on the condition of the motor 132, determining a mass flow rate of the fluid through the motor 132; and based on the mass flow rate the fluid through the motor 132, determines a life expectancy of the motor 132.

The local controller 160 receives signals from the first temperature sensor 168 (in a single differential temperature sensor configuration), the first temperature sensor 168 and the second temperature sensor 170 (in the two-temperature sensor configuration), and the other sensors 176 indicating the values of the conditions of the wellbore 102, the motor 132, and the motor head 154. Based on the values of the conditions of the wellbore 102, the motor 132, and the motor head 154, the local controller 160 calculates the mass flow rate of the motor by $$\dot{m} = \frac{\dot{Q}}{C_p(T_{out} - T_{in})}.$$

The listed variables include: $\dot{m}$ (the mass flow rate of fluids in the motor 132 in kg/sec), $\dot{Q}$ (the energy supplied in the motor 132 in Watts by the power source 142), $C_p$ (a specific heat capacity of the fluid in J/kgK in the motor 132), $T_{out}$ (a fluid temperature at the motor 132 at the uphole end 174 in ° C.), and $T_{in}$ (a fluid temperature at the downhole end 172 of the motor 132 in ° C.).

The local controller 160 determines the life expectancy of the motor by comparing the actual energy loss and the calculated mass flow rate to a design energy loss and a design mass flow rate for the motor on an efficiency curve plot.

The local controller 160 of the motor head 154 can also communicate with an accumulator local controller 188 (described in more detail below) to supply clean dielectric oil into and through the motor 132. In this sense, the motor head 154 is one communications node and the accumulator 178 is another communications node in a communications network.

The local controller 160 can operate the accumulator 178. The local controller 160 receives the condition of the dielectric oil in the motor head 154 from one of the sensors 176; compares the value of the dielectric condition of the dielectric oil in the motor head 154 to a threshold value of the dielectric condition of the dielectric oil in the motor head 154; and based on a result of the comparison, can operate the accumulator 178 (described below in detail) to supply clean dielectric oil to and through the motor 132 to the motor head 154.

Based on the result of the comparison, the local controller 160 can also adjust the life expectancy of the motor 132. For example, when a lower quantity of clean dielectric oil is being supplied to the motor 132 and motor head 154 during a given time interval, indicating a lower quantity of dielectric oil is leaking out of the protector/seal 150 or less fluid from the wellbore 102 is leaking into the motor head 154 past the protector/seal 150 than expected, the local controller 160 can increase the life expectancy of the motor 132. For example, when a higher quantity of clean dielectric oil is being supplied to the motor 132 and motor head 154 during the given time interval, indicating a higher quantity of dielectric oil is leaking out of the protector/seal 150 or more fluid from the wellbore 102 is leaking into the motor head 154 past the protector/seal 150 than expected, the local controller 160 can decrease the life expectancy of the motor 132.

The local controller 160 can also operate the accumulator 178 based on a condition of the dielectric oil at the downhole end 172 of the motor 132. An accumulator dielectric oil sensor 190 (described in more detail below) can sense an electrical condition of the dielectric oil at the downhole end 172 of the motor 132 and transmits a value representing the electrical condition to the local controller 160, or the accumulator local controller 188 can transmit the value representing the electrical condition at the downhole end 172 of the motor 132 to the local controller 160. The local controller 160 receives the value of the dielectric condition of the dielectric oil in the motor 132; compared the value of the dielectric condition of the dielectric oil in the motor 132 to a threshold value of the dielectric condition of the dielectric oil in the motor 132; and based on a result of the comparison, can operate the accumulator 178 (described below in detail) to supply clean dielectric oil to and through the motor 132 to the motor head 154. Based on the result of the comparison, the local controller 160 can also adjust the life expectancy of the motor 132.

The local controller 160 includes a telemetry transceiver 192. The telemetry transceiver 192 transmits a status signal to a remote controller 194. The remote controller 194 can be positioned in the proximity to the wellhead assembly 112 (i.e., at the well site) or at a remote control station 196 away from the wellbore 102. The remote control station 196 can be the operating station at the surface 104 of the Earth which receives the reprogramming signal through the wellbore and or the power cable 144. The local controller 160 can transmit the determined life expectancy of the motor 132 to the remote controller 194 by the telemetry transceiver 192.

When the protector/seal 150 degrades as previously described, fluids from the wellbore 102 can leak by the protector/seal 150 and into the motor head 154 and mix with the dielectric oil in the motor head 154 or even ingress as far as the motor 132. The contamination of the dielectric oil by the wellbore fluids changes the property of the dielectric oil. The sensors 176 can sense the conductivity or resistivity of the contaminated dielectric oil and transmits a signal including the value of the conductivity or resistivity to the local controller 160. For example, in reference to the conductivity of the dielectric oil, when the dielectric oil is clean (uncontaminated), the dielectric oil will have a low electrical conductivity. For example, the electrical conductivity can be low when the electrical conductivity is less than $10^{-10}$ S/m. When the dielectric oil has mixed with wellbore fluids (contaminated), the dielectric oil will have a high electrical conductivity. For example, the electrical conductivity can be high when the electrical conductivity is greater than $10^{-4}$ S/m. This is because the wellbore fluids, especially water and salts, have a high conductivity relative to the dielectric oil. Likewise, in reference the resistance of the dielectric oil, when the dielectric oil is clean (uncontaminated), the dielectric oil will have a high resistance. When the dielectric oil has mixed with wellbore fluids (contaminated), the dielectric oil will have a low resistance. This is because the wellbore fluids, especially water and salts, have a low resistance relative to the dielectric oil.

The assembly 100 includes an accumulator 178. The accumulator 178 is coupled to the motor 132. The accumulator 178 contains an uncontaminated (clean) dielectric oil. The accumulator 178 flows the uncontaminated dielectric oil to the motor 132. The accumulator 178 includes a piston 180 which is movably within the accumulator 178. The piston 180 forces the clean dielectric oil into the motor 132. The accumulator 178 includes a spring 182. The spring 182 is positioned within the accumulator 178 and expands to move the piston 180 to force the clean dielectric oil in the direction of arrow 184 into the motor 132.

The accumulator 178 includes a dielectric oil control valve 186. The dielectric oil control valve 186 controls the flow of the clean dielectric oil from the accumulator 178 to the motor 132.

The accumulator 178 includes the accumulator local controller 188 and the accumulator dielectric oil sensor 190. The accumulator dielectric oil sensor 190 senses an electrical condition of the dielectric oil at the downhole end 172 of the motor 132 and transmits a value representing the electrical condition to the accumulator local controller 188. The accumulator local controller 188 is operatively coupled to the piston 180, the accumulator dielectric control valve 186, and the accumulator dielectric oil sensor 190. The accumulator local controller 188 receives the signal representing the value of the conductivity of the dielectric oil in the downhole end 172 of the motor 132. The accumulator local controller 188 generates a command signal to the dielectric oil control valve 186 to flow or stop flowing clean dielectric oil from the accumulator 178 into the motor 132.

The accumulator local controller 188 receives the signal including the value of the conductivity of the dielectric oil from the accumulator dielectric oil sensor 190. The accumulator local controller 188 compares the value of the conductivity of the dielectric oil to a threshold value stored in the accumulator local controller 188. The threshold value is a value of conductivity which indicates a presence of contaminated dielectric oil at the downhole end 172 of the motor 132. The threshold value is a value of conductivity above which the motor functions normally. The threshold value corresponds to a minimum dielectric strength of the dielectric oil. In other words, the fluids from the wellbore 102 have leaked by the protector/seal 150, through the motor head 154 and into the motor 132, mixing with the clean dielectric oil. The accumulator local controller 188 determines when the value of the conductivity of the dielectric oil at the downhole end 172 of the motor 132 is greater (a high conductivity) than the threshold value.

Responsive to determining that the value of the conductivity of the dielectric oil in the motor 132 at the downhole end 172 is greater than the threshold value (indicating a presence of contaminated dielectric oil), the accumulator local controller 188 flows clean dielectric oil from the accumulator 178 to the motor 132 to expel the contaminated dielectric oil out of the motor 132 back by the leaking protector/seal 150. In other words, the contaminated dielectric oil is expelled back out via the route that it entered the protector/seal 150. Clean dielectric oil can flow from the accumulator 178 until the accumulator 178 no longer contains clean dielectric oil. As seen, flowing the clean dielectric oil to the leaking protector/seal 150 may not be a permanent correction to fix the leaking protector/seal 150. The flow of clean dielectric oil from the accumulator 178 can alert the user that the protector/seal 150 has an integrity problem, which can lead to a motor 132 electrical failure. In some cases, the accumulator local controller 188 can flow clean dielectric oil from the accumulator 178 to the motor 132 for a pre-set time to expel some or all of the contaminated dielectric oil out of the motor 132 back by the leaking protector/seal 150. This process can be repeated as required until the accumulator 178 no longer contains clean dielectric oil. The accumulator local controller 188 can determine that the accumulator 178 is empty by using a known number of times the dielectric oil control valve 186 has been actuated multiplied by the pre-set time to equal the volume of dielectric oil flowed from the accumulator 178. In other words, only a pre-set number of actuations can be achieved based on accumulator volume and the pre-set flow time. The accumulator local controller 188 will count-down the dielectric oil control valve 186 actuations. The accumulator local controller 188 transmits number of valve actuations to the user. The accumulator local controller 188 monitors the conductivity of the dielectric oil between each actuation for a finite amount of time to determine if the dielectric oil control valve 186 should be actuated again to restore the conductivity below the threshold value.

The accumulator dielectric oil sensor 190 periodically senses the conductivity of the dielectric oil at the downhole end 172 of the motor 132 and transmits the signals including the value of the conductivity to the accumulator local controller 188. Sensing the conductivity of the dielectric oil can include a time interval between sensing the conductivity. For example, the accumulator dielectric oil sensor 190 can sense the conductivity every one second, five seconds, or ten seconds. The time interval can be adjustable. The accumulator local controller 188 continues to compare the value of the conductivity of the dielectric oil at the downhole end 172 of the motor 132 to the threshold value. The accumulator local controller 188 determines when the value of the conductivity of the dielectric oil in the at the downhole end 172 of the motor 132 is less than the threshold value by continually sampling the conductivity of the dielectric oil. In some cases, the accumulator local controller 188 will not actuate the dielectric oil control valve 186 again until the conductivity of the dielectric oil rises above the threshold value, that is, the dielectric oil is more conductive (has a lower insulation value).

The accumulator local controller 188 can include a computer with a microprocessor. The accumulator local controller 188 has one or more sets of programmed instructions stored in a memory or other non-transitory computer-readable media that stores data (e.g., connected with the printed circuit board), which can be accessed and processed by a microprocessor. The programmed instructions can include, for example, instructions for sending or receiving signals and commands to operate the dielectric oil control valve 186 and or the piston 180 and/or collect and store data from the accumulator dielectric oil sensor 190. The accumulator local controller 188 stores values (signals and commands) against which sensed values (signals and commands) representing the condition are compared. Processing data from the accumulator dielectric oil sensor 190 at the accumulator local controller 188 can improve processing speed and accuracy, a concept know as edge processing.

The accumulator local controller 188 includes another telemetry transceiver 192. The accumulator telemetry transceiver 192 can transmit a status signal to the remote controller 194 and/or on to the remote control station 196. The remote control station 196 can be the operating station at the surface 104 of the Earth which receives the reprogramming signal through the wellbore and or the power cable 144. For example, the number of times the dielectric oil control valve 186 has been actuated for the pre-set time and/or the balance of actuations remaining can be transmitted from the accumulator local controller 188 to the remote control station 196.

The telemetry transceiver 192 can also receives a command signal from the remote control station 196. For example, the command signal from the remote control s can instruct the one or more computer processors to open or close the dielectric oil control valve 186 for the pre-set time.

In other implementations of the present disclosure, the motor head 154 is a sub-assembly which can be coupled to an existing electrical submersible pump that has been removed from the wellbore 102 during a workover operation. For example, an existing electrical submersible pump can be removed from the wellbore 102 after a motor 132 short or protector/seal 150 failure. The electrical submersible pump can be cleaned, the motor head 154 attached to the motor 132, and a new protector/seal 150 can be coupled to the motor head 154. The pump 118 is then attached to the protector/seal 150 and the refurbished electrical submersible pump assembly 100 can be disposed in the wellbore 102 and the fluids produced from the wellbore 102. The life expectancy of the refurbished electrical submersible pump assembly 100 can be determined.

Figure 2:
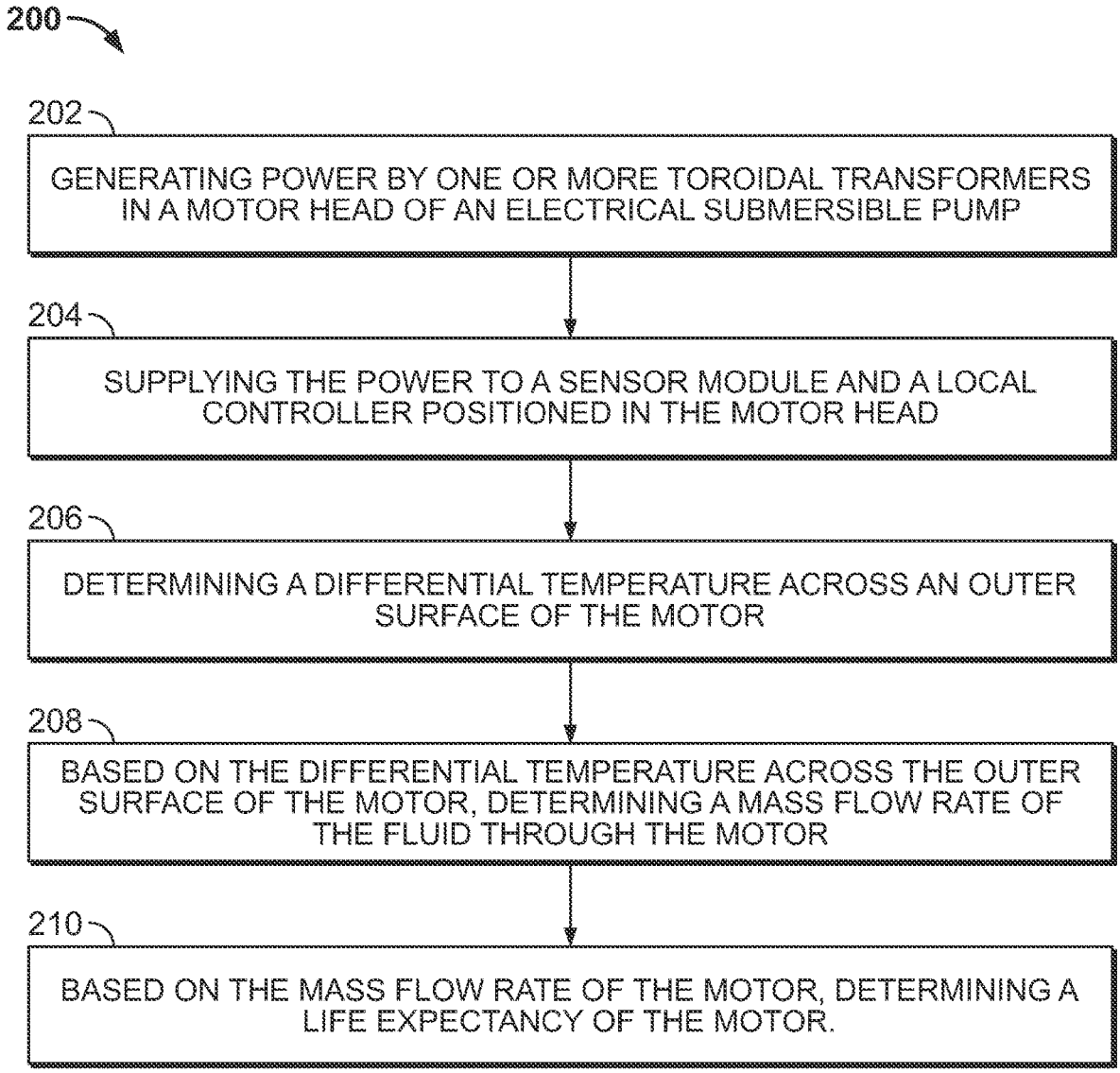
FIG. 2 is a flow chart of an example method of lubricating an electric submersible pump according to the implementations of the present disclosure.

FIG. 2 is a flow chart of an example method 200 of determining a electric submersible pump according to the implementations of the present disclosure. A dielectric oil in the electric submersible pump is refreshed. The electric submersible pump operates in a subterranean oil or water well. At 202, power is generated by one or more toroidal transformers in a motor head of an electrical submersible pump. For example, the toroidal transformers 158 in the motor head 154 can generate electrical power when electricity flows through the power cable 144 disposed through the toroidal transformers 158.

At 204, the power is supplied to a sensor module and a local controller positioned in the motor head. For example, the toroidal transformers 158 supply the electrical power to the local controller 160 and the sensor module 158.

At 206, a differential temperature is determined across an outer surface of the motor. For example, the first and second temperature sensors 168, 170 and sense the fluid temperature on the outer surface 166 of the motor 132 and transmit the signal representing the value of the respective temperatures to the local controller 160.

At 208, based on the differential temperature across the outer surface of the motor, a mass flow rate of the fluid through the motor is determined by $$\dot{m} = \frac{\dot{Q}}{C_p(T_{out} - T_{in})}.$$

The variable $\dot{m}$ is the mass flow rate of the fluid in kg/sec in the motor. The variable $\dot{Q}$ is the energy supplied to the motor in Watts. The variable $C_p$ is a specific heat capacity of the fluid in J/kgK in the motor. The variable $T_{out}$ is a fluid temperature at a motor uphole end in ° C. The variable $T_{in}$ is a fluid temperature at a motor downhole end in ° C.

At 210, based on the mass flow rate of the motor, a life expectancy of the motor is determined. Determining the life expectancy of the motor based on the mass flow rate of the motor can include comparing the actual energy loss and the calculated mass flow rate to a design energy loss and a design mass flow rate for the motor on an efficiency curve plot. For example, the local controller 160 can include a database storing values in tables corresponding to the actual energy loss, the calculated mass flow rate, the design energy loss, and the design mass flow rate for the motor 132. Based on the calculated mass flow rate of the motor 132, the local controller 160 can determine the life expectancy of the motor 132.

Embodiments

In an example aspect, an electrical submersible pump assembly includes a motor, a motor head coupled to the motor, a power cable extending into the motor head, a sensor module, and a local controller. The motor head has one or more toroidal transformers. The power cable extends into the motor head through the one or more toroidal transformers to the motor. The sensor module receives power from the one or more toroidal transformers, detects a condition of the motor, and transmits a signal representing the condition of the motor. The local controller is contained within the motor head. The local controller is coupled to the motor and the sensor module. The local controller performs operations including receiving electrical power from the one or more toroidal transformers; receiving the signal representing the condition of the motor; based on the condition of the motor, determining a mass flow rate of the motor; and based on the mass flow rate of the motor, determining a life expectancy of the motor.

In an example aspect combinable with any other example aspect, the electrical submersible pump assembly includes a temperature sensor to detect a differential temperature of a fluid passing across an outer surface of the motor and transmit a signal representing the differential temperature to the local controller.

In an example aspect combinable with any other example aspect, the temperature sensor includes a downhole temperature sensor and an uphole end temperature sensor. The downhole temperature sensor is positioned at a downhole end of the motor. The downhole temperature sensor senses a downhole end temperature of the fluid and transmit a signal representing the downhole end temperature to the local controller. The uphole end temperature sensor positioned at an uphole end of the motor. The uphole end temperature sensor senses an uphole end temperature of the fluid and transmit a signal representing the uphole end temperature to the local controller.

In an example aspect combinable with any other example aspect, the condition of the motor is the differential temperature across the outer surface of the motor. In such an aspect, determining the mass flow rate of the motor can include calculating the mass flow rate by $$\dot{m} = \frac{\dot{Q}}{C_p(T_{out} - T_{in})},$$

where $\dot{m}$ is the mass flow rate of fluids in the motor in kg/sec, $\dot{Q}$ is the energy supplied in the motor in Watts, $C_p$ is a specific heat capacity of the fluid in J/kgK in the motor, $T_{out}$ is a fluid temperature at the motor uphole end in ° C., and $T_{in}$ is a fluid temperature at the motor downhole end in ° C.

In an example aspect combinable with any other example aspect, determining the life expectancy of the motor based on the energy loss of the motor can include comparing the actual energy loss and the calculated mass flow rate to a design energy loss and a design mass flow rate for the motor on an efficiency curve plot.

In an example aspect combinable with any other example aspect, the local controller transmits the determined life expectancy of the motor to a remote controller.

In an example aspect, the power cable includes three conductors. Each of the three conductors conduct a different phase of a three-phase electrical signal to the motor. The toroidal transformers can include three toroidal transformers where each of the three conductors are positioned through a different toroidal transformer.

In an example aspect, the power cable includes a single conductor and the one or more toroidal transformers includes one toroidal transformer.

In an example aspect combinable with any other example aspect, the motor head includes an electrical storage device electrically coupled to the one or more toroidal transformers, the sensor module, and the local controller.

In an example aspect combinable with any other example aspect, the electrical storage device includes one or more of a battery or a capacitor.

In an example aspect combinable with any other example aspect, the motor head further includes a dielectric oil sensor to sense a dielectric condition of the dielectric oil in the motor head received from the motor and transmit a signal representing a value of the dielectric condition of the dielectric oil in the motor head to the local controller.

In an example aspect combinable with any other example aspect, the local controller is further configured to perform operations includes receiving the value of the dielectric condition of the dielectric oil in the motor head; comparing the value of the dielectric condition of the dielectric oil in the motor head to a threshold value of the dielectric condition of the dielectric oil in the motor head; and based on a result of the comparison, adjusting the life expectancy of the motor.

In an example aspect combinable with any other example aspect, the electrical submersible pump assembly includes a dielectric sensor coupled to the motor. The dielectric sensor senses a dielectric condition of the dielectric oil in the motor and transmits a signal representing a value of the dielectric condition of the motor. The local controller receives the value of the dielectric condition of the dielectric oil in the motor; comparing the value of the dielectric condition of the dielectric oil in the motor to a threshold value of the dielectric condition of the dielectric oil in the motor; and based on a result of the comparison, adjusting the life expectancy of the motor.

In an example aspect combinable with any other example aspect, the electrical submersible pump assembly includes a dielectric oil accumulator to supply clean dielectric oil into a downhole end of the motor. The local controller, based on the result of the comparison, supplies clean dielectric oil from the dielectric oil accumulator into the motor.

In an example aspect combinable with any other example aspect, the local controller is further configured to supply the clean dielectric oil from the dielectric oil accumulator into the motor, through the motor, into the motor head, and out the motor head.

In an example aspect combinable with any other example aspect, the local controller is configured to, based on the result of the comparison, operate the dielectric oil accumulator to flow the clean dielectric oil from the local controller to the motor head for one or more of a preset time or until the result of the comparison indicates a healthy dielectric oil quality condition in the motor head.

In another example aspect, an electrical submersible pump motor head includes a motor head case, a pothead coupled to the motor head case, one or more toroidal transformers positioned within the motor head case, a power cable positioned within the motor head case, a sensor module, and a local controller. The power cable is coupled to the pothead and extends through the one or more toroidal transformers. The sensor module receives power from the one or more toroidal transformers, detects a condition of the motor, and transmits a signal representing the condition of the motor. The local controller is contained within the motor head. The local controller is coupled to the motor and the sensor module. The local controller receives electrical power from the one or more toroidal transformers; receives the signal representing the condition of the motor; based on the condition of the motor, determines a mass flow rate of the motor; and based on the mass flow rate of the motor, determines a life expectancy of the motor.

In an example aspect combinable with any other example aspect, the condition of the motor is the differential temperature across the outer surface of the motor. Determining the mass flow rate of the motor can include calculating the mass flow rate by $$\dot{m} = \frac{\dot{Q}}{C_p(T_{out} - T_{in})},$$

where $\dot{m}$ is the mass flow rate of fluids in kg/sec through the motor, $\dot{Q}$ is the energy supplied to the motor in Watts, $C_p$ is a specific heat capacity of the fluid in J/kgK in the motor, $T_{out}$ is a fluid temperature at the motor uphole end in ° C., and $T_{in}$ is a fluid temperature at the motor downhole end in ° C.

In yet another example aspect, a method includes generating power by one or more toroidal transformers in a motor head of an electrical submersible pump; supplying the power to a sensor module and a local controller positioned in the motor head; determining a differential temperature across an outer surface of the motor; based on the differential temperature across the outer surface of the motor, determining a mass flow rate of the fluid through the motor by $$\dot{m} = \frac{\dot{Q}}{C_p(T_{out} - T_{in})},$$

where $\dot{m}$ is the mass flow rate of the fluid in kg/sec in the motor, $\dot{Q}$ is the energy supplied to the motor in Watts, $C_p$ is a specific heat capacity of the fluid in J/kgK in the motor, $T_{out}$ is a fluid temperature at a motor uphole end in ° C., and $T_{in}$ is a fluid temperature at a motor downhole end in ° C.; and based on the mass flow rate of the motor, determining a life expectancy of the motor.

In an example aspect combinable with any other example aspect, determining the life expectancy of the motor based on the mass flow rate of the motor includes comparing the actual energy loss and the calculated mass flow rate to a design energy loss and a design mass flow rate for the motor on an efficiency curve plot.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The invention claimed is:

1. An electrical submersible pump assembly comprising:

a motor;

a motor head coupled to the motor, the motor head comprising one or more toroidal transformers;

a power cable extending into the motor head through the one or more toroidal transformers to the motor;

a sensor module configured to perform operations comprising:

receiving power from the one or more toroidal transformers;

detecting a condition of the motor; and transmitting a signal representing the condition of the motor; and a local controller contained within the motor head, the local controller coupled to the motor and the sensor module, the local controller configured to perform operations comprising:

receiving electrical power from the one or more toroidal transformers;

receiving the signal representing the condition of the motor, wherein the condition of the motor is a differential temperature across an outer surface of the motor;

based on the condition of the motor, determining a mass flow rate of the motor by $$\dot{m} = \frac{\dot{Q}}{C_p(T_{out} - T_{in})},$$

wherein $\dot{m}$ is the mass flow rate of fluids in the motor in kg/sec, $\overline{Q}$ is the energy supplied in the motor in Watts, $C_p$ is a specific heat capacity of the fluid in J/kgK in the motor, $T_{out}$ is a fluid temperature at an uphole end of the motor in ° C., and $T_{in}$ is a fluid temperature at a downhole end of the motor in ° C.; and based on the mass flow rate of the motor, determining a life expectancy of the motor.

2. The electrical submersible pump assembly of claim 1, wherein the sensor module comprises a temperature sensor configured to:

detect the differential temperature as a differential fluid temperature of a fluid passing across the outer surface of the motor, the differential fluid temperature comprising the fluid temperature at the uphole end of the motor and the fluid temperature at the downhole end of the motor; and transmit the signal representing the condition of the motor which is the differential temperature to the local controller.

3. The electrical submersible pump assembly of claim 2, wherein the temperature sensor comprises:

a downhole temperature sensor positioned at the downhole end of the motor, the downhole temperature sensor configured to sense the fluid temperature at the downhole end of the motor; and an uphole end temperature sensor positioned at the uphole end of the motor, the uphole end temperature sensor configured to sense the fluid temperature at the uphole end of the motor.

4. The electrical submersible pump assembly of claim 1, wherein determining the life expectancy of the motor further comprises comparing an actual energy loss and the calculated mass flow rate for the motor to a design energy loss and a design mass flow rate for the motor on an efficiency curve plot.

5. The electrical submersible pump assembly of claim 4, wherein the local controller is further configured to transmit the determined life expectancy of the motor to a remote controller.

6. The electrical submersible pump assembly of claim 1, wherein:

the power cable comprises three conductors, each of the three conductors configured conduct a different phase of a three-phase electrical signal to the motor; and the one or more toroidal transformers comprises three toroidal transformers, each of the three conductors positioned through a different toroidal transformer.

7. The electrical submersible pump assembly of claim 1, wherein:

the power cable comprises a single conductor; and the one or more toroidal transformers comprise one toroidal transformer.

8. The electrical submersible pump assembly of claim 1, wherein the motor head further comprises an electrical storage device electrically coupled to the one or more toroidal transformers, the sensor module, and the local controller.

9. The electrical submersible pump assembly of claim 8, wherein the electrical storage device comprises one or more of a battery or a capacitor.

10. The electrical submersible pump assembly of claim 1, wherein the motor head further comprises a dielectric oil sensor configured to:

sense a dielectric condition of the dielectric oil in the motor head received from the motor; and transmit a signal representing a value of the dielectric condition of the dielectric oil in the motor head to the local controller.

11. The electrical submersible pump assembly of claim 10, wherein the local controller is further configured to perform operations comprising:

receiving the value of the dielectric condition of the dielectric oil in the motor head;

comparing the value of the dielectric condition of the dielectric oil in the motor head to a threshold value of the dielectric condition of the dielectric oil in the motor head; and based on a result of the comparison, adjusting the life expectancy of the motor.

12. The electrical submersible pump assembly of claim 11, further comprising a dielectric sensor coupled to the motor, the dielectric sensor configured to:

sense a dielectric condition of the dielectric oil in the motor;

transmit a signal representing a value of the dielectric condition of the motor; and the local controller is further configured to perform operations comprising:

receiving the value of the dielectric condition of the dielectric oil in the motor;

comparing the value of the dielectric condition of the dielectric oil in the motor to a threshold value of the dielectric condition of the dielectric oil in the motor; and based on a result of the comparison, adjusting the life expectancy of the motor.

13. The electrical submersible pump assembly of claim 11, further comprising a dielectric oil accumulator configured to supply clean dielectric oil into the downhole end of the motor, wherein the local controller is further configured to perform operations comprising, based on the result of the comparison, supplying clean dielectric oil from the dielectric oil accumulator into the motor.

14. The electrical submersible pump assembly of claim 13, wherein the local controller is further configured to supply the clean dielectric oil from the dielectric oil accumulator into the motor, through the motor, into the motor head, and out the motor head.

15. The electrical submersible pump assembly of claim 13, wherein the local controller is configured to perform operations comprising, based on the result of the comparison, operating the dielectric oil accumulator to flow the clean dielectric oil from the local controller to the motor head for one or more of a preset time or until the result of the comparison indicates a healthy dielectric oil quality condition in the motor head.

16. An electrical submersible pump motor head comprising:

a motor head case;

a pothead coupled to the motor head case;

one or more toroidal transformers positioned within the motor head case;

a power cable positioned within the motor head case, the power cable coupled to the pothead and extending through the one or more toroidal transformers; and a sensor module configured to perform operations comprising:

receiving power from the one or more toroidal transformers;

detecting a condition of the motor; and transmitting a signal representing the condition of the motor; and a local controller contained within the motor head, the local controller coupled to the motor and the sensor module, the local controller configured to perform operations comprising:

receiving electrical power from the one or more toroidal transformers;

receiving the signal representing the condition of the motor, wherein the condition of the motor is the differential temperature across the outer surface of the motor;

based on the condition of the motor, determining a mass flow rate of the motor by $$\dot{m} = \frac{\dot{Q}}{C_p(T_{out} - T_{in})},$$

wherein $\dot{m}$ is the mass flow rate of fluids in the motor in kg/sec, $\dot{Q}$ is the energy supplied in the motor in Watts, $C_p$ is a specific heat capacity of the fluid in J/kgK in the motor, $T_{out}$ is a fluid temperature at an uphole end of the motor in ° C., and $T_{in}$ is a fluid temperature at a downhole end of the motor in ° C.; and based on the mass flow rate of the motor, determining a life expectancy of the motor.

17. A method comprising:

generating power by one or more toroidal transformers in a motor head of an electrical submersible pump comprising a motor coupled to the motor head, the motor head, the one or more toroidal transformers, a power cable extending into the motor head through the one or more toroidal transformers to the motor, a sensor module, and a local controller contained within the motor head;

supplying the power to the sensor module and the local controller positioned in the motor head, wherein the local controller is coupled to the motor and the sensor module;

determining a differential temperature across an outer surface of the motor, wherein the differential temperature represents the condition of the motor;

based on the differential temperature across the outer surface of the motor, determining a mass flow rate of a fluid flowing through the motor by $$\dot{m} = \frac{\dot{Q}}{C_p(T_{out} - T_{in})},$$

wherein $\dot{m}$ is the mass flow rate of the fluid in kg/sec in the motor, $\dot{Q}$ is the power supplied to the motor in Watts, $C_p$ is a specific heat capacity of the fluid in J/kgK in the motor, $T_{out}$ is a fluid temperature at an uphole end of the motor in ° C., and $T_{in}$ is a fluid temperature at a downhole end of the motor in ° C.; and based on the mass flow rate of the fluid flowing through the motor the motor, determining a life expectancy of the motor.

18. The method of claim 17, wherein, determining the life expectancy of the motor based on the mass flow rate of the fluid flowing through the motor comprises comparing an actual energy loss and the determined mass flow rate of the fluid flowing through the motor to a design energy loss and a design mass flow rate for the fluid flowing through the motor on an efficiency curve plot.

* * * * *